US007271800B2

(12) United States Patent
Choi et al.

(10) Patent No.: US 7,271,800 B2
(45) Date of Patent: Sep. 18, 2007

(54) APPARATUS FOR DRIVING PLASMA DISPLAY PANEL PERFORMING ADDRESS-DISPLAY MIXING DRIVING SCHEME

(75) Inventors: Hak-Ki Choi, Cheonan-si (KR); Kyoung-Ho Kang, Suwon-si (KR); Seung-Hun Chae, Suwon-si (KR); Min-Sun Yoo, Cheonan-si (KR); Woo-Joon Jeong, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 702 days.

(21) Appl. No.: 10/846,655

(22) Filed: May 17, 2004

(65) Prior Publication Data

US 2004/0227702 A1 Nov. 18, 2004

(30) Foreign Application Priority Data

May 16, 2003 (KR) ..... 10-2003-0031147

(51) Int. Cl.
*G09G 5/00* (2006.01)

(52) U.S. Cl. ..... 345/204; 345/37; 345/210; 345/211; 345/214; 315/169.4

(58) Field of Classification Search ..... 345/37, 345/41, 60, 65, 204, 205, 210, 211, 214, 690; 315/169.4

See application file for complete search history.

(56) References Cited

U.S. PATENT DOCUMENTS 7,075,528 B2 * 7/2006 Sano et al. ..... 345/211

2003/0001513 A1 * 1/2003 Onozawa et al. ..... 315/169.3

FOREIGN PATENT DOCUMENTS

KR 2002-0094713 12/2002

* cited by examiner

*Primary Examiner*—Bipin Shalwala
*Assistant Examiner*—Vincent E. Kovalick
(74) *Attorney, Agent, or Firm*—H.C. Park & Associates, PLC

(57) ABSTRACT

A scan electrode drive of an apparatus for driving a plasma display panel includes a switching output circuit, a reset/sustain circuit, an upper scan circuit, a lower scan circuit, a first switching circuit, and a second switching circuit. The switching output circuit includes upper transistors, lower transistors each paired with corresponding upper transistor, and common output lines of the respective upper and lower transistor pairs, and the common output lines are connected to the scan electrode lines, respectively. The reset/sustain circuit outputs the driving signals during the reset period and the display-sustain period. The first switching circuit connects or disconnects the upper common power line of all of the upper transistors of the switching output circuit to or from an output terminal of the reset/sustain circuit. The second switching circuit connects or disconnects the lower common power line of all of the lower transistors of the switching output circuit to or from the output terminal of the reset/sustain circuit.

13 Claims, 8 Drawing Sheets

APPARATUS FOR DRIVING PLASMA DISPLAY PANEL PERFORMING ADDRESS-DISPLAY MIXING DRIVING SCHEME

BACKGROUND OF THE INVENTION

This application claims the priority of Korean Patent Application No. 2003-31147, filed on May 16, 2003, in the Korean Intellectual Property Office, the disclosure of which is incorporated herein in its entirety by reference.

1. Field of the Invention

The present invention relates to an apparatus for driving a triode plasma display panel, and more particularly, to an apparatus for driving a surface discharge type triode plasma display panel in which X-electrode lines and Y-electrode lines are alternately arranged in parallel, thereby forming XY-electrode pairs, and display cells are defined in areas where the XY-electrode lines intersect address electrode lines.

2. Description of the Related Art

FIG. 1 shows the structure of a surface discharge type triode plasma display panel. FIG. 2 shows an example of a display cell of the plasma display panel shown in FIG. 1. Referring to FIGS. 1 and 2, address electrode lines $A_{R1}$, $A_{G1}, \ldots, A_{Gm}, A_{Bm}$, dielectric layers 11 and 15, Y-electrode lines $Y_1, \ldots, Y_n$, X-electrode lines $X_1, \ldots, X_n$, phosphor layers 16, partition walls 17, and a magnesium oxide (MgO) layer 12 as a protective layer are provided between front glass substrate 10 and rear glass substrate 13 of a general surface discharge plasma display panel 1.

The address electrode lines $A_{R1}$ through $A_{Bm}$ are formed on the front surface of the rear glass substrate 13 in a predetermined pattern. A rear dielectric layer 15 is formed on the entire surface of the rear glass substrate 13 having the address electrode lines $A_{R1}$ through $A_{Bm}$. The partition walls 17 are formed on the front surface of the rear dielectric layer 15 to be parallel to the address electrode lines $A_1$ through $A_m$. These partition walls 17 define the discharge areas of respective display cells and serve to prevent cross talk between display cells. The phosphor layers 16 are formed between partition walls 17.

The X-electrode lines $X_1$ through $X_n$ and the Y-electrode lines $Y_1$ through $Y_n$ are formed on the rear surface of the front glass substrate 10 in a predetermined pattern to be orthogonal to the address electrode lines $A_{R1}$ through $A_{Bm}$. The respective intersections define display cells. Each of the X-electrode lines $X_1$ through $X_n$ is composed of a transparent electrode line $X_{na}$ (FIG. 2) formed of a transparent conductive material, e.g., indium tin oxide (ITO), and a metal electrode line $X_{nb}$ (FIG. 2) for increasing conductivity. Each of the Y-electrode lines $Y_1$ through $Y_n$ is composed of a transparent electrode line $Y_{na}$ (FIG. 2) formed of a transparent conductive material, e.g., ITO, and a metal electrode line $Y_{nb}$ (FIG. 2) for increasing conductivity. A front dielectric layer 11 is deposited on the entire rear surface of the front glass is substrate 10 having the rear surfaces of the X-electrode lines $X_1$ through $X_n$ and the Y-electrode lines $Y_1$ through $Y_n$. The protective layer 12, e.g., a MgO layer, for protecting the panel 1 against a strong electrical field is deposited on the entire surface of the front dielectric layer 11. A gas for forming plasma is hermetically sealed in a discharge space 14.

In a driving method used by such a plasma display panel, a reset period, an address period, and a display-sustain period are sequentially performed in each subfield. In the reset period, charges in all display cells are in a uniform state. In the address period, a predetermined wall voltage is induced in selected display cells. In the display-sustain period, a predetermined alternating current voltage is applied to all of the XY-electrode line pairs so that a display-sustain discharge occurs in the selected display cells in which the predetermined wall voltage was induced during the address period. Accordingly, plasma is formed in the discharge space 14, i.e., a gas layer, of each selected display cell, and ultraviolet rays are emitted therefrom. As a result, the phosphor layer 16 is excited, thereby emitting light.

Referring to FIG. 3, a typical driving apparatus for the plasma display panel 1 shown in FIG. 1 includes a video processor 66, a logic controller 62, an address driver 63, an X-driver 64, and a Y-driver 65. The video processor 66 converts an external analog video signal into a digital signal to generate an internal video signal composed of, for example, 8-bit red (R) video data, 8-bit green (G) video data, 8-bit blue (B) video data, a clock signal, a horizontal synchronizing signal, and a vertical synchronizing signal. The logic controller 62 generates driving control signals $S_A$, $S_Y$, and $S_X$ in response to the internal video signal from the video processor 66. The address driver 63 processes the address signal SA among the driving control signals $S_A$, $S_Y$, and $S_X$ output from the logic controller 62 to generate a display data signal and applies the display data signal to address electrode lines. The X-driver 64 processes the X-driving control signal $S_X$ among the driving control signals $S_A$, $S_Y$, and $S_X$ output from the logic controller 62 and applies the result of processing to X-electrode lines. The Y-driver 65 processes the Y-driving control signal $S_Y$ among the driving control signals $S_A$, $S_Y$, and $S_X$ output from the logic controller 62 and applies the result of processing to Y-electrode lines.

An address-display separation driving scheme can be used in the plasma display panel 1 as described in U.S. Pat. No. 5,541,618, which is hereby incorporated by reference in its entirety. In the address-display separation driving scheme, the address period and the display-sustain period are separated in terms of time domain in each subfield included in a unit frame. Accordingly, during the address period, each XY-electrode line pair is held in standby after being addressed until all of the other XY-electrode line pairs are addressed. Such a standby period makes the wall charges in each display cell disordered. As a result, in the display-sustain period starting from an end point of the address period, accuracy of display-sustain discharge is decreased.

Referring to FIG. 4, the Y-driver (65 of FIG. 3) of a typical driving apparatus using the address-display separation driving scheme includes a reset/sustain circuit RSC, a scan driving circuit AC, and a switching output circuit SIC. The reset/sustain circuit RSC generates driving signals $O_{RS}$ to be applied to the Y-electrode lines $Y_1$ through $Y_n$ during the reset period and the display-sustain period. The scan driving circuit AC generates driving signals to be applied to the Y-electrode lines $Y_1$ through $Y_n$ during the address period. The switching output circuit SIC includes upper transistors YU1 through YUn and lower transistors YL1 through YLn. Common output lines of the respective upper and lower transistor pairs are connected to the Y-electrode lines $Y_1$ through $Y_n$, respectively. An operation of the Y-driver shown in FIG. 4 will be described with reference to FIGS. 1 and 4.

During the reset period and the display-sustain period, the driving signals $O_{RS}$ generated by the reset/sustain circuit RSC are applied to the Y-electrode lines $Y_1$ through $Y_n$ of the plasma display panel 1 via a node A of the scan driving circuit AC and the lower transistors YL1 through YLn of the switching output circuit SIC. In this situation, first through fourth high power transistors $S_{SC1}$, $S_{SC2}$, $S_{SP}$, and $S_{SCL}$ of the scan driving circuit AC are all turned off. The driving signals $O_{RS}$ may be applied to the Y-electrode lines $Y_1$ through $Y_n$ of the plasma display panel 1 via the node A of the scan driving circuit AC, the third high power transistor $S_{SP}$, and the upper transistors YU1 through YUn of the switching output circuit SIC. In this situation, the high power transistors $S_{SC1}$, $S_{SC2}$, and $S_{SCL}$ other than the third high power transistor $S_{SP}$ are turned off.

During the address period, the high power transistors $S_{SC1}$, $S_{SC2}$, and $S_{SCL}$ other than the third high power transistor $S_{SP}$ of the scan driving circuit AC are turned on. Then, a scan bias voltage $V_{SCAN}$ is applied to the upper transistors YU1 through YUn of the switching output circuit SIC via the first and second high power transistors $S_{SC1}$ and $S_{SC2}$. In addition, a ground voltage is applied to the lower transistors YL1 through YLn of the switching output circuit SIC via the fourth high power transistor $S_{SCL}$. Then, a lower transistor connected to a Y-electrode line to be scanned is turned on, and an upper transistor connected to the Y-electrode line to be scanned is turned off. In addition, lower transistors connected to the other Y-electrodes not to be scanned are turned off, and upper transistors connected thereto are turned on. As a result, a scan ground voltage is applied to the Y-electrode line to be scanned, and the scan bias voltage $V_{SCAN}$ is applied to the other Y-electrode lines not to be scanned.

The following description concerns current paths respectively when the scan ground voltage is applied to the Y-electrode line to be scanned, when the display data signal is applied to the address electrode lines $A_{R1}$ through $A_{Bm}$, when the application of the display data signal to the address electrode lines $A_{R1}$ through $A_{Bm}$ is terminated, and when the application of the scan ground voltage to the Y-electrode line being scanned is terminated, during the address period.

When the scan ground voltage is applied to the Y-electrode line to be scanned, a current flows from display cells (i.e., electric capacitors) connected to the Y-electrode line to be scanned to a ground terminal via a lower transistor of the switching output circuit SIC and the fourth high power transistor $S_{SCL}$ of the scan driving circuit AC.

When the display data signal is applied to the address electrode lines $A_{R1}$ through $A_{Bm}$, a discharge current flows from address electrode lines to which a selection voltage is applied to the Y-electrode line which is being scanned, and a current flows to a terminal of the scan bias voltage $V_{SCAN}$ via the other Y-electrode lines which are not being scanned, upper transistors of the switching output circuit SIC, and the first and second high power transistors $S_{SC1}$ and $S_{SC2}$ of the scan driving circuit AC.

When the application of the display data signal to the address electrode lines $A_{R1}$ through $A_{Bm}$ is terminated, a current flows from the terminal of the scan bias voltage $V_{SCAN}$ to the address electrode lines $A_{R1}$ through $A_{Bm}$ via the first and second high power transistors $S_{SC1}$ and $S_{SC2}$ of the scan driving circuit AC, upper transistors of the switching output circuit SIC, and Y-electrode lines.

When the application of the scan ground voltage to the Y-electrode line being scanned is terminated, a current flows from the terminal of the scan bias voltage $V_{SCAN}$ to the display cells via the first and second high power transistors $S_{SC1}$ and $S_{SC2}$ of the scan driving circuit AC, upper transistors of the switching output circuit SIC, and Y-electrode lines.

Accordingly, it can be inferred that a high power transistor for switching needs to be connected between an upper common line of the upper transistors YU1 through YUn of the switching output circuit SIC and the terminal of the scan bias voltage $V_{SCAN}$. When only a single high power transistor $S_{SC1}$ or $S_{SC2}$ is connected, the following problems occur.

When only the second high power transistor $S_{SC2}$ is connected, during the reset period and the display-sustain period, the driving signals $O_{RS}$ of the reset/sustain circuit RSC are applied to the terminal of the scan bias voltage $V_{SCAN}$ via an internal diode of the second high power transistor $S_{SC2}$, and thus a current flows. As a result, a driving operation during the reset period and the display-sustain period is instable and requires high power consumption.

When only the first high power transistor $S_{SC1}$ is connected, an unexpected over-shoot pulse of the terminal of the scan bias voltage $V_{SCAN}$ may be applied to all of the upper transistors YU1 through YUn of the switching output circuit SIC via an internal diode of the first high power transistor $S_{SC1}$. As a result, a driving operation during all of the periods is instable.

Consequently, two high power transistors $S_{SC1}$ and $S_{SC2}$ are needed.

In the meantime, when the third high power transistor $S_{SP}$ is not connected and thus the upper common line of the upper transistors YU1 through YUn is merely disconnected with a lower common power line of the lower transistors YL1 through YLn, during the reset period and the display-sustain period, the driving signals $O_{RS}$ of the reset/sustain circuit RSC are applied to all of the Y-electrode lines $Y_1$ through $Y_n$ via all of the lower transistors YL1 through YLn of the switching output circuit SIC and also applied to the first high power transistor $S_{SC1}$ via internal diodes of the upper transistors YU1 through YUn and the second high power transistor $S_{SC2}$ of the scan driving circuit AC. As a result, the performance and the life span of the first high power transistor $S_{SC1}$ are decreased. However, when the third high power transistor $S_{SP}$ is connected, a voltage is dropped down by a predetermined level by the third high power transistor $S_{SP}$ so that a voltage applied to the first high power transistor $S_{SC1}$ can be decreased.

In the typical driving apparatus using a Y-driver having the above-described structure, even when all of the lower transistors YL1 through YLn of the switching output circuit SIC are turned off, the driving signals ORS of the reset/sustain circuit RSC are applied to all of the Y-electrode lines $Y_1$ through $Y_n$ via the lower common power line and the internal diodes of the upper transistors YU1 through YUn. Accordingly, in a typical address-display separation driving apparatus using the above-described Y-driver, the address period must be separated from the display-sustain period in terms of time domain in each subfield included in a unit frame. In this situation, during the address period, each XY-electrode line pair is necessarily held in standby after being addressed until all of the other XY-electrode lines are addressed. Due to an existence of the standby duration after addressing, a state of wall charges in each display cell is disordered. As a result, in the display-sustain period starting from an end point of the address period, accuracy of display-sustain discharge decreases.

SUMMARY OF THE INVENTION

The present invention provides an apparatus for driving a plasma display panel, which decreases a standby period between a time when display cells are completely addressed and a time when remaining XY-electrode line pairs are completely addressed and increases accuracy of display-sustain discharge.

The present invention provides an apparatus for driving a plasma display panel. The apparatus includes a video processor which converts an external analog video signal into a digital signal to generate an internal video signal, a logic controller which generates address, X-, and Y-driving control signals in response to the internal video signal from the video processor; an address driver which applies a display data signal to address electrode lines according to the address driving control signal output from the logic controller; an X-driver which applies an X-driving signal to X-electrode lines according to the X-driving control signal output from the logic controller; and a Y-driver which applies a Y-driving signal to Y-electrode lines according to the Y-driving control signal output from the logic controller. The apparatus performs a reset operation to make charges in all display cells uniform, an address period to induce a predetermined wall voltage in selected display cells, and a display-sustain period to provoke a display-sustain discharge in the selected display cells in which the predetermined wall voltage has been induced at a predetermined time. The Y-driver includes a switching output circuit, a reset/sustain circuit, an upper scan circuit, a lower scan circuit, a first switching circuit, and a second switching circuit.

The switching output circuit comprises upper transistors, lower transistors each paired with corresponding upper transistor, and common output lines of the respective upper and lower transistor pairs. The common output lines are connected to the Y-electrode lines, respectively. The reset/sustain circuit outputs the driving signals during the reset period and the display-sustain period. The upper scan circuit is connected to an upper common power line of all of the upper transistors of the switching output circuit to apply a scan bias voltage to the Y-electrode lines not to be scanned during the address period. The lower scan circuit is connected to a lower common power line of all of the lower transistors of the switching output circuit to apply a scan voltage to the Y-electrode lines to be scanned during the address period. The first switching circuit connects or disconnects the upper common power line of all of the upper transistors of the switching output circuit to or from an output terminal of the reset/sustain circuit. The second switching circuit connects or disconnects the lower common power line of all of the lower transistors of the switching output circuit to or from the output terminal of the reset/sustain circuit.

According to the present invention, the Y-driver connects or disconnects the upper and lower common power lines to or from the output terminal of the reset/sustain circuit using the first and second switching circuits. Accordingly, driving signals of the reset/sustain circuit can be controlled to be applied to all of the Y-electrode lines via the upper and lower common power lines and the internal diodes of all of the transistors of the switching output circuit. As a result, in each subfield, addressing and display-sustain discharge are alternately performed, and a display-sustain signal can be applied only to XY-electrode line pair groups on which addressing has been completed. Accordingly, this decreases a standby duration of an XY-electrode line pair group between a time the XY-electrode line pair group is completely addressed and a time when other XY-electrode line pair groups are completely addressed and increases accuracy of display-sustain discharge.

BRIEF DESCRIPTION OF THE DRAWINGS

The above and other features and advantages of the present invention will become more apparent by describing in detail preferred embodiments thereof with reference to the attached drawings.

DETAILED DESCRIPTION OF THE INVENTION

Figure 5:
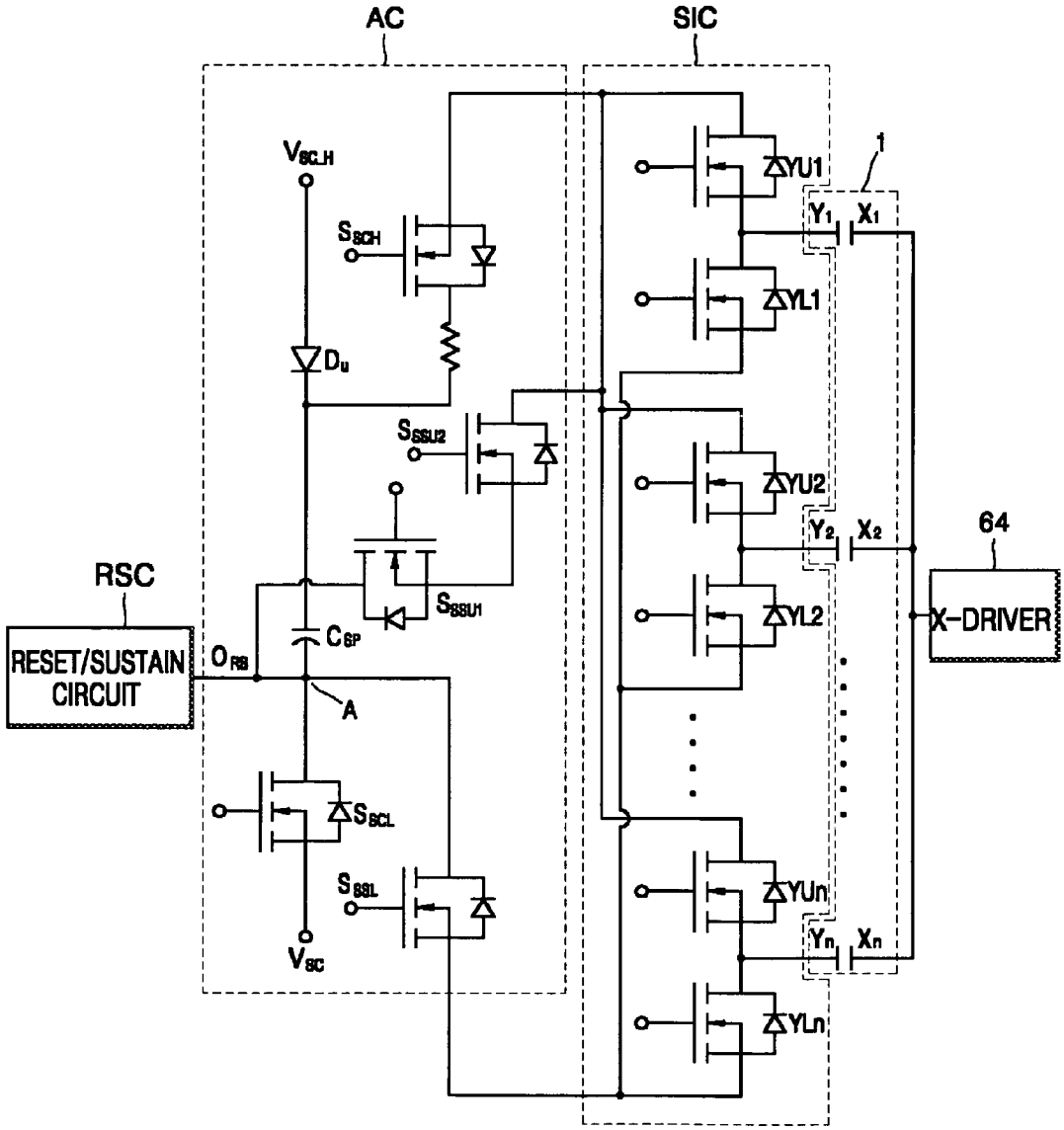
FIG. 5 is a diagram of a Y-driver of a driving apparatus according to an embodiment of the present invention.

FIG. 5 is a diagram of a Y-driver of a driving apparatus according to an embodiment of the present invention. The Y-driver of the present invention corresponds to the Y-driver 65 shown in FIG. 3.

Figure 3:
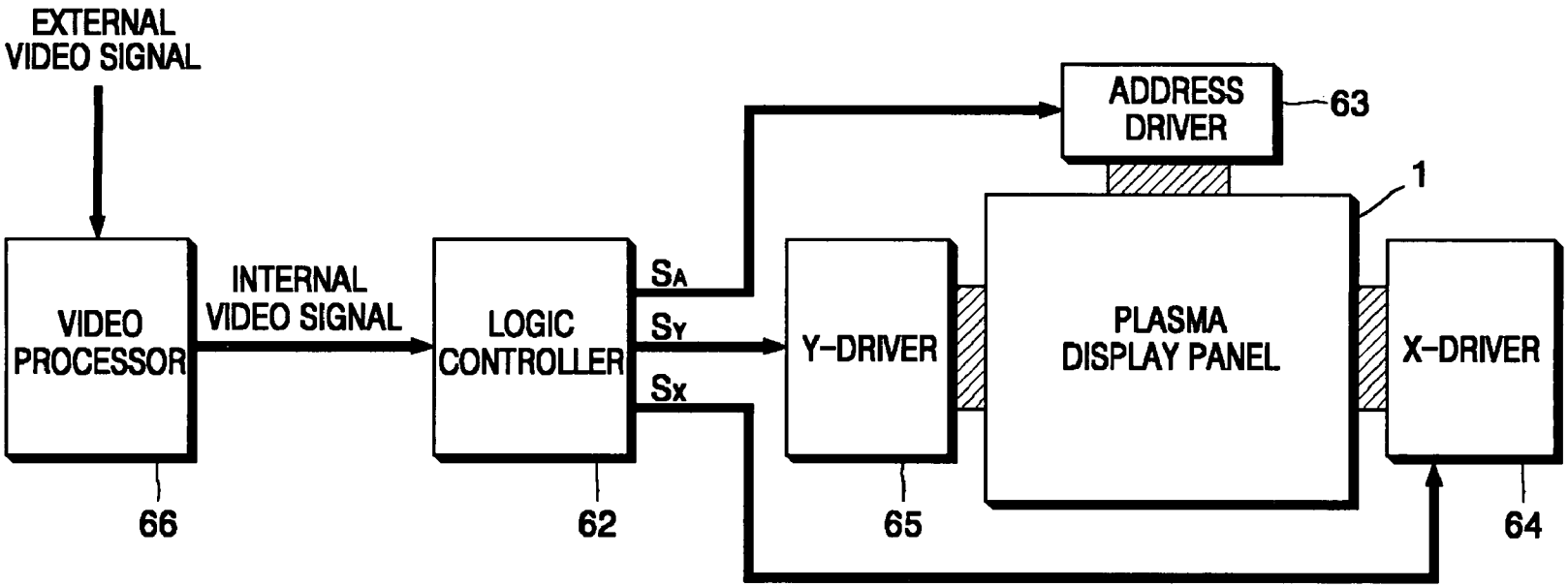
FIG. 3 (PRIOR ART)
FIG. 3 is a block diagram of a typical driving apparatus for the plasma display panel shown in FIG. 1.

Referring to FIGS. 3 and 5, the driving apparatus for a plasma display panel 1 according to the present invention includes a video processor 66, a logic controller 62, an address driver 63, an X-driver 64, and a Y-driver 65. The video processor 66 converts an external analog video signal into a digital signal to generate an internal video signal composed of, for example, 8-bit red (R) video data, 8-bit green (G) video data, 8-bit blue (B) video data, a clock signal, a horizontal synchronizing signal, and a vertical synchronizing signal. The logic controller 62 generates driving control signals $S_A$, $S_Y$, and $S_X$ in response to the internal video signal from the video processor 66. The address driver 63 processes the address signal $S_A$ among the driving control signals $S_A$, $S_Y$, and $S_X$ output from the logic controller 62 to generate a display data signal and applies the display data signal to address electrode lines. The X-driver 64 processes the X-driving control signal $S_X$ among the driving control signals $S_A$, $S_Y$, and $S_X$ output from the logic controller 62 and applies the result of processing to X-electrode lines. The Y-driver 65 processes the Y-driving control signal $S_Y$ among the driving control signals $S_A$, $S_Y$, and $S_X$ output from the logic controller 62 and applies the result of processing to Y-electrode lines.

The driving apparatus having the above-described structure according to the embodiment of the present invention performs a reset period, an address period, and a display-sustain period in each subfield. In the reset period, charges in all display cells are set to be in a uniform state. In the address period, a predetermined wall voltage is induced in selected display cells. In the display-sustain period, a display-sustain discharge occurs in the selected display cells, in which the predetermined wall voltage was induced, at a predetermined time.

The Y-driver 65 includes a reset/sustain circuit RSC, a scan driving circuit AC, and a switching output circuit SIC. The scan driving circuit AC includes upper scan circuits including a diode $D_U$ and a field effect transistor $S_{SCH}$, a lower scan circuit $S_{SCL}$, a first switching circuit including a first transistor $S_{SSU1}$ and a second transistor $S_{SSU2}$, and a second switching circuit $S_{SSL}$.

The switching output circuit SIC includes upper transistors YU1 through YUn and lower transistors YL1 through YLn. Common output lines of the respective upper and lower transistor pairs are connected to Y-electrode lines $Y_1$ through $Y_n$, respectively. All of the transistors YU1 through YUn and YL1 through YLn of the switching output circuit SIC are field effect transistors. Each of the field effect transistors YU1 through YUn and YL1 through YLn includes an internal diode. An anode of the internal diode is connected to a source of a corresponding field effect transistor. A cathode of the internal diode is connected to a drain of the corresponding field effect transistor. The sources of the upper transistors YU1 through YUn and the drains of the lower transistors YL1 through YLn are connected to the Y-electrode lines $Y_1$ through $Y_n$, respectively.

The reset/sustain circuit RSC outputs driving signals $O_{RS}$ necessary during the reset period and the display-sustain period.

A capacitor $C_{SP}$ is connected between the upper scan circuit $D_U$+$S_{SCH}$ and the lower scan circuit $S_{SCL}$. A voltage induced by charging the capacitor $C_{SP}$ is applied to an upper common power line of the upper transistors YU1 through YUn of the switching output circuit SIC via the field effect transistor $S_{SCH}$ of the upper scan circuit $D_U$+$S_{SCH}$.

The upper scan circuit $D_U$+$S_{SCH}$ is connected to the upper common power line of the switching output circuit SIC and applies a scan bias voltage $V_{SC_H}$ to Y-electrode lines which are not scanned during the address period. The scan bias voltage $V_{SC_H}$ is a little higher than a ground voltage. The field effect transistor $S_{SCH}$ of the upper scan circuit $D_U$+$S_{SCH}$ connects or disconnects the upper common power line of the switching output circuit SIC to or from a terminal of the scan bias voltage $V_{SC_H}$. The field effect transistor $S_{SCH}$ includes an internal diode. An anode of the internal diode is connected to a source of the field effect transistor $S_{SCH}$, a cathode of the internal diode is connected to a drain of the field effect transistor $S_{SCH}$. The source of the field effect transistor $S_{SCH}$ is connected to the upper common power line of the upper transistors YU1 through YUn of the switching output circuit SIC. The diode $D_U$ is connected between the drain of the field effect transistor $S_{SCH}$ and the scan bias voltage $V_{SC_H}$ as a one-direction current control device. A cathode of the diode $D_U$, one end of the capacitor $C_{SP}$, and the drain of the field effect transistor $S_{SCH}$ are commonly connected with one another.

The lower scan circuit $S_{SCL}$ is connected to a lower common power line of the lower transistors YL1 through YLn of the switching output circuit SIC and applies a negative scan voltage $V_{SC}$ to Y-electrode lines which are scanned during the address period. More specifically, a field effect transistor as the lower scan circuit $S_{SCL}$ is connected between the other end of the capacitor $C_{SP}$ and a terminal of the scan voltage $V_{SC}$. The field effect transistor as the lower scan circuit $S_{SCL}$ includes an internal diode. An anode of the internal diode is connected to a source of the field effect transistor $S_{SCL}$, and a cathode of the internal diode is connected to a drain of the field effect transistor $S_{SCL}$. The source of the field effect transistor $S_{SCL}$ is connected to the terminal of the scan voltage $V_{SC}$, and the drain of the field effect transistor $S_{SCL}$ is connected to the other end of the capacitor $C_{SP}$.

The first switching circuit $S_{SSU1}$+$S_{SSU2}$ connects or disconnects the upper common power line of the upper transistors YU1 through YUn of the switching output circuit SIC to or from an output terminal of the reset/sustain circuit RSC. The first and second transistors $S_{SSU1}$ and $S_{SSU2}$ of the first switching circuit are connected between the upper common power line and the output terminal of the reset/sustain circuit RSC. Each of the first and second transistors $S_{SSU1}$ and $S_{SSU2}$ is a field effect transistor including an internal diode. Anodes of the respective internal diodes are respectively connected to sources of the respective first and second transistors $S_{SSU1}$ and $S_{SSU2}$. Cathodes of the respective internal diodes are respectively connected to drains of the respective first and second transistors $S_{SSU1}$ and $S_{SSU2}$. The drain of the first transistor $S_{SSU1}$ is connected to the output terminal of the reset/sustain circuit RSC. The drain of the second transistor $S_{SSU2}$ is connected to the upper common power line of the upper transistors YU1 through YUn of the switching output circuit SIC. The source of the first transistor $S_{SSU1}$ is connected to the source of the second transistor $S_{SSU2}$. During the address period while the first and second transistors $S_{SSU1}$ and $S_{SSU2}$ are turned off, the internal diode of the first transistor $S_{SSU1}$ does not allow the scan voltage $V_{SC}$ to be applied to the upper common power line of the upper transistors YU1 through YUn. Accordingly, the first switching circuit needs the two transistors $S_{SSU1}$ and $S_{SSU2}$.

The second switching circuit $S_{SSL}$ connects or disconnects the lower common power line of the lower transistors YL1 through YLn to or from the output terminal of the reset/sustain circuit RSC. Accordingly, the driving signals $O_{RS}$ of the reset/sustain circuit RSC are controlled to be applied to all of the Y-electrode lines $Y_1$ through $Y_n$ via the internal diodes of the respective lower transistors YL1 through YLn.

For example, when the second switching circuit $S_{SSL}$ is disconnected, positive pulses of the reset/sustain circuit RSC are applied to the upper transistors YU1 through YUn via the first switching circuit $S_{SSU1}$+$S_{SSU2}$, and the upper transistors YU1 through YUn are selectively turned on, display-sustain signals can be selectively applied to each XY-electrode line pair group including at least one XY-electrode line pair. Accordingly, in each subfield, the address period and the display-sustain period are alternately performed, and the display-sustain signals are applied only to XY-electrode line pair groups on which addressing is completed. This shortens a standby duration of an XY-electrode line pair group from a time when the XY-electrode line pair group is completely addressed to a time when all of the other XY-electrode line pair groups are completely addressed, and increases accuracy of display-sustain discharge.

The second switching circuit $S_{SSL}$ is implemented by a field effect transistor connected between the lower common power line of the lower transistors YL1 through YLn of the switching output circuit SIC and the output terminal of the reset/sustain circuit RSC. The field effect transistor $S_{SSL}$ includes an internal diode. An anode of the internal diode is connected to a source of the field effect transistor $S_{SSL}$, and a cathode of the internal diode is connected to a drain of the field effect transistor $S_{SSL}$. The source of the field effect transistor $S_{SSL}$ is connected to the lower common power line of the lower transistors YL1 through YLn, and the drain of the field effect transistor $S_{SSL}$ is connected to the output terminal of the reset/sustain circuit RSC.

Figure 1:
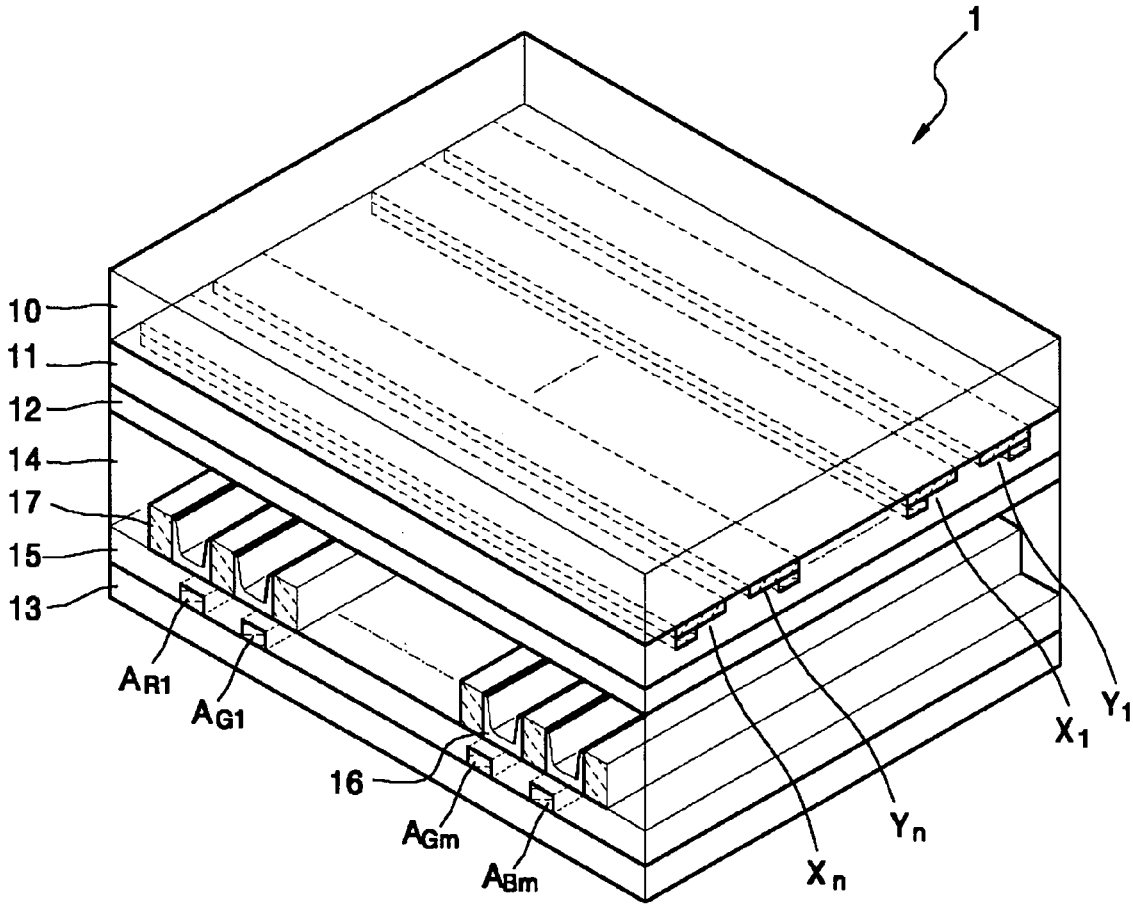
FIG. 1 (PRIOR ART)
FIG. 1 is a perspective view of the internal structure of a typical surface discharge type triode plasma display panel.
Figure 2:
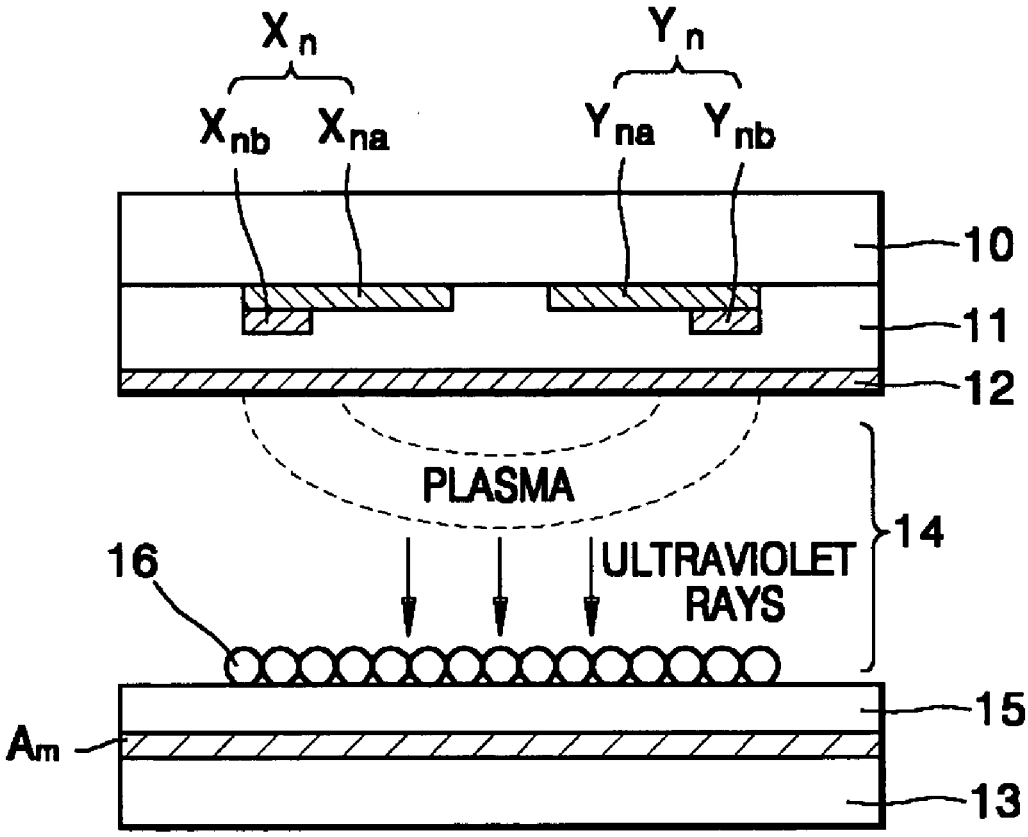
FIG. 2 (PRIOR ART)
FIG. 2 is a sectional view of an example of a display cell in the plasma display panel shown in FIG. 1.
Figure 6:
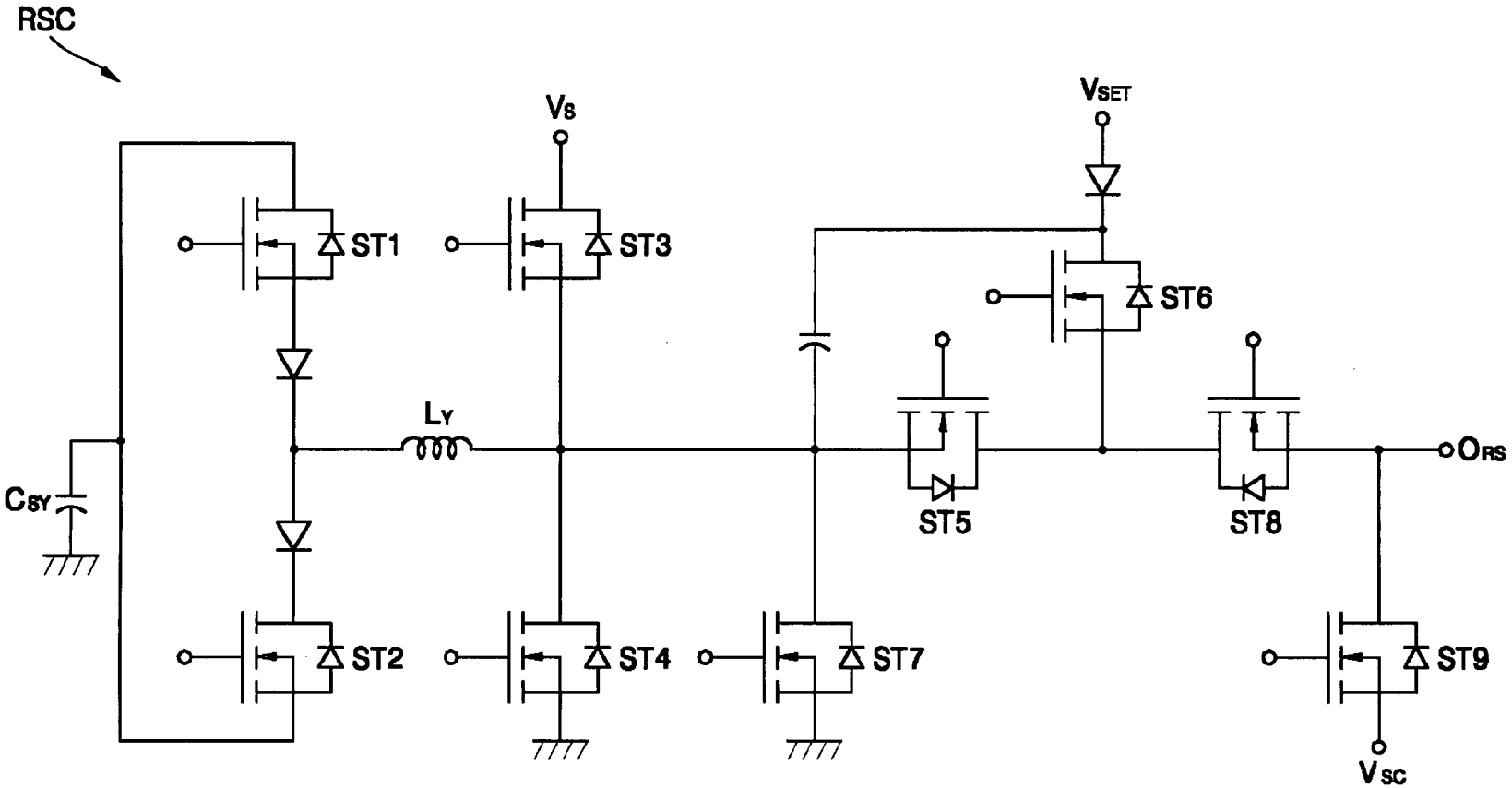
FIG. 6 is a diagram of the reset/sustain circuit included in the Y-driver shown in FIG. 5.
Figure 7:
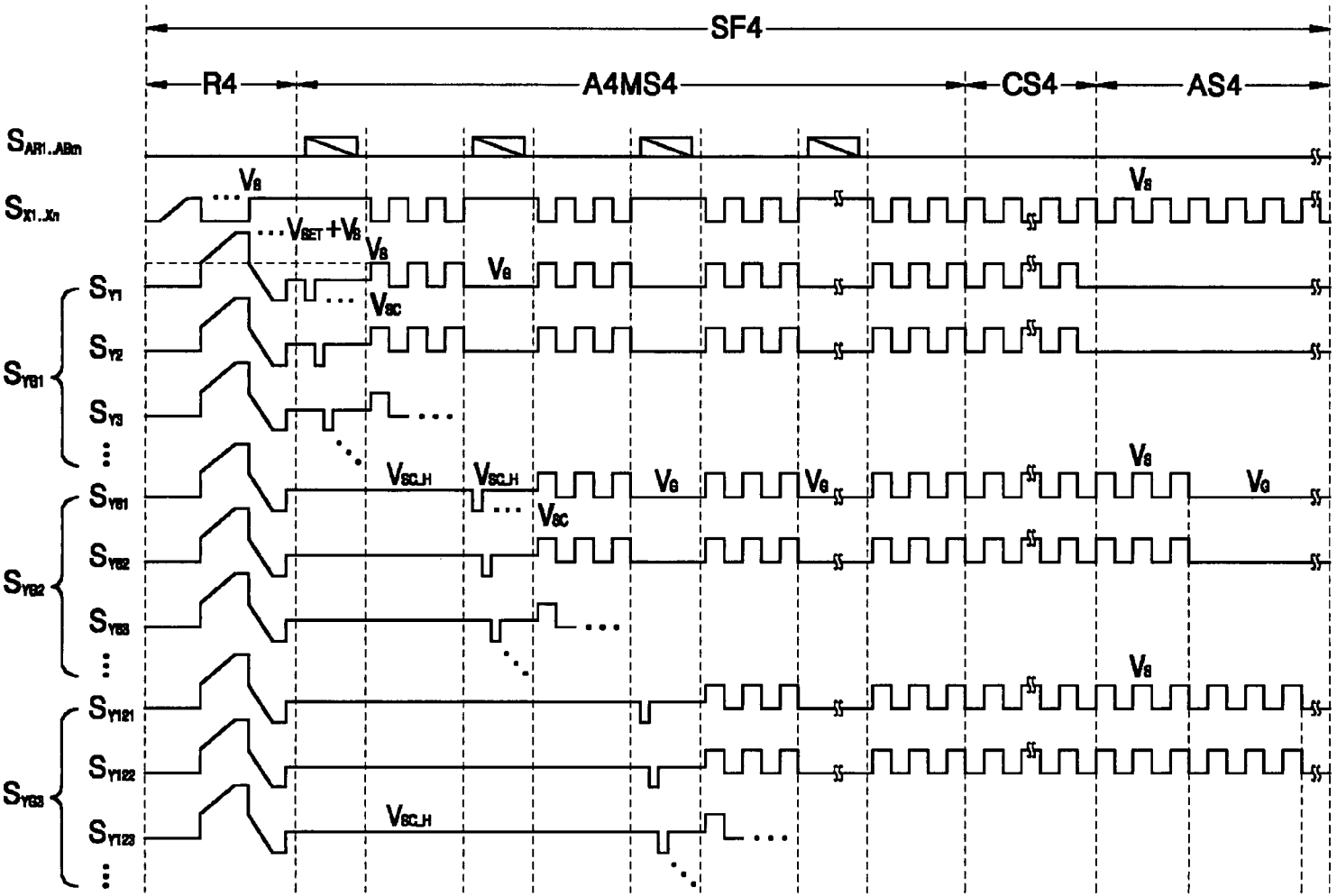
FIG. 7 is a timing chart showing voltage waveforms of driving signals applied to electrode lines in a subfield by the circuits shown in FIGS. 5 and 6.
Figure 8A:
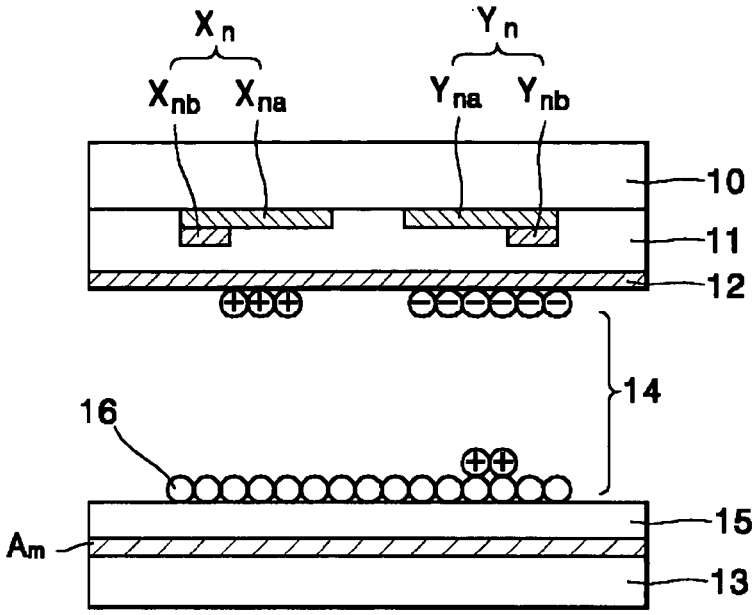
FIG. 8A is a cross-section showing a distribution of wall charges in a certain display cell immediately after a gradually increasing voltage is applied to Y-electrode lines during a reset period of FIG. 7.
Figure 8B:
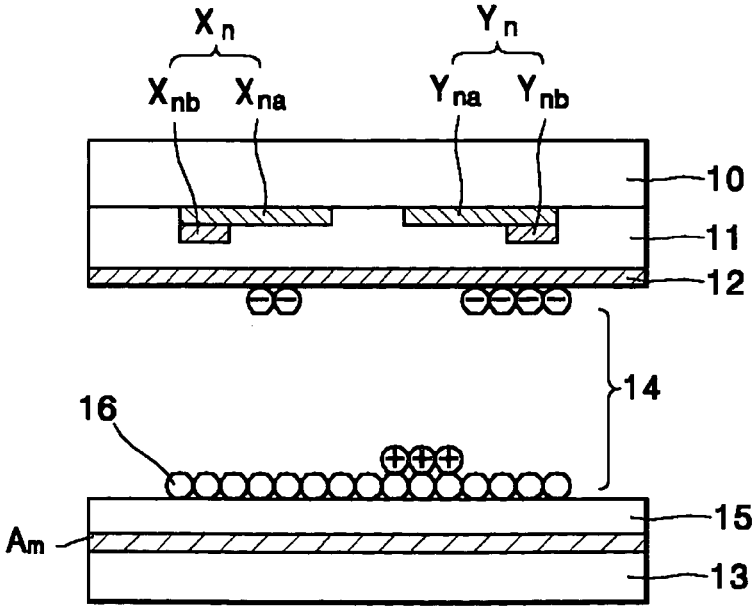
FIG. 8B is a cross-section showing a distribution of wall charges in a certain display cell at an end point of the reset period of FIG. 7.

FIG. 7 is a timing chart showing voltage waveforms of driving signals applied to electrode lines in a subfield SF4 by the circuits shown in FIGS. 5 and 6. In FIG. 7, a reference character $S_{AR1 \ldots ABm}$ denotes a display data signal applied from the address driver 63 of FIG. 3 to the address electrode lines $A_{R1}$ through $A_{Bm}$ of FIG. 1. A reference character $S_{X1 \ldots Xn}$ denotes a driving signal applied from the X-driver 64 of FIG. 3 to the X-electrode lines $X_1$ through $X_n$ of FIG. 1. Reference characters $S_{YG1}$ through $S_{YG3}$ denote driving signals applied from the Y-driver 65 of FIG. 3 to respective Y-electrode groups. A reference character R4 denotes a reset period. A reference character A4MS4 denotes a mixed period in which an address period and a mixed display-sustain period coexist. A reference character CS4 denotes a common display-sustain period. A reference character AS4 denotes a compensation display-sustain period.

An operation of the Y-driver shown in FIG. 5 will be described with reference to FIGS. 5 and 7.

During the reset period R4 and the common display-sustain period CS4, the field effect transistor as the lower scan circuit $S_{SCL}$, the field effect transistor $S_{SCH}$ of the upper scan circuit $D_U$+$S_{SCH}$, and the first and second transistors $S_{SSU1}$ and $S_{SSU2}$ of the first switching circuit $S_{SSU1}$+$S_{SSU2}$ are turned off. In contrast, the field effect transistor as the second switching circuit $S_{SSL}$ is turned on. As a result, the driving signals $O_{RS}$ of the reset/sustain circuit RSC are applied to the lower common power line of the lower transistors YL1 through YLn of the switching output circuit SIC. Then, the lower transistors YL1 through YLn are turned on, and the upper transistors YU1 through YUn are turned off. Consequently, the driving signals $O_{RS}$ of the reset/sustain circuit RSC are applied to the Y-electrode lines $Y_1$ through $Y_n$ via the lower transistors YL1 through YLn.

During the mixed period A4MS4 including the address period and the mixed display-sustain period, an addressing operation of the address period and a display-sustain operation of the mixed display-sustain period are alternately performed. For example, during a first unit time, the addressing operation is performed on a first Y-electrode group. During a second unit time, the display-sustain operation is performed on the first Y-electrode group on which the addressing operation has been completed. During a third unit time, the addressing operation is performed on a second Y-electrode group. During a fourth unit time, the display-sustain operation is simultaneously performed on the first and second Y-electrode groups on which the addressing operation has been completed. During a fifth unit time, the addressing operation is performed on a third Y-electrode group. During a sixth unit time, the display-sustain operation is simultaneously performed on the first through third Y-electrode groups on which the addressing operation has been completed. When these operations are generalized, during the mixed period A4MS4, the addressing operation is performed on each Y-electrode group during each odd-numbered unit time, and the display-sustain operation is performed on a Y-electrode group or Y-electrode groups on which the addressing operation has been completed during each even-numbered unit time.

Accordingly, during the odd-numbered unit time while the addressing operation is performed, the field effect transistor $S_{SCH}$ of the upper scan circuit $D_U$+$S_{SCH}$, the field effect transistor as the lower scan circuit $S_{SCL}$, and the field effect transistor as the second switching circuit $S_{SSL}$ are turned on. In contrast, the first and second transistors $S_{SSU1}$ and $S_{SSU2}$ of the first switching circuit $S_{SSU1}$+$S_{SSU2}$ are turned off. As a result, the scan bias voltage $V_{SC_H}$ induced by charging the capacitor $C_{SP}$ is applied to the upper common power line of the upper transistors YU1 through YUn via the upper scan circuit $D_U$+$S_{SCH}$. The scan bias voltage $V_{SC_H}$ is a little higher than a ground voltage $V_G$. In addition, the negative scan voltage $V_{SC}$ is applied to the lower transistors YL1 through YLn via the lower scan circuit $S_{SCL}$ and the second switching circuit $S_{SSL}$. Then, a lower transistor connected to a Y-electrode line to be scanned is turned on, and an upper transistor connected to the Y-electrode line to be scanned is turned off. The other lower transistors connected to the other Y-electrode lines not to be scanned are turned off, and the other upper transistors connected to the other Y-electrode lines not to be scanned are turned on. Accordingly, the negative scan voltage $V_{SC}$ is applied to the Y-electrode line to be scanned, and the scan bias voltage $V_{SC_H}$ is applied to the other Y-electrode lines not to be scanned.

The following description concerns current paths respectively when the negative scan voltage $V_{SC}$ is applied to the Y-electrode line to be scanned, when the display data signal is applied to the address electrode lines $A_{R1}$ through $A_{Bm}$, when the application of the display data signal to the address electrode lines $A_{R1}$ through $A_{Bm}$ is terminated, and when the application of the negative scan voltage $V_{SC}$ to the Y-electrode line being scanned is terminated, while the addressing operation is performed during each odd-numbered unit time.

When the negative scan voltage $V_{SC}$ is applied to the Y-electrode line to be scanned, a current flows from display cells (i.e., electric capacitors) connected to the Y-electrode line to be scanned to the lower scan circuit $S_{SCL}$ via a lower transistor of the switching output circuit SIC and the second switching circuit $S_{SSL}$.

When the display data signal is applied to the address electrode lines $A_{R1}$ through $A_{Bm}$, a discharge current flows from address electrode lines to which a selection voltage is applied to the Y-electrode line which is being scanned, and a current flows to the lower scan circuit $S_{SCL}$ via the other Y-electrode lines which are not being scanned, upper transistors of the switching output circuit SIC, the field effect transistor $S_{SCH}$ of the upper scan circuit $D_U$+$S_{SCH}$, and the capacitor $C_{SP}$.

When the application of the display data signal to the address electrode lines $A_{R1}$ through $A_{Bm}$ is terminated, a current flows from the capacitor $C_{SP}$ to the address electrode lines $A_{R1}$ through $A_{Bm}$ via the field effect transistor $S_{SCH}$ of the upper scan circuit $D_U$+$S_{SCH}$, upper transistors of the switching output circuit SIC, and Y-electrode lines.

When the application of the negative scan voltage $V_{SC}$ to the Y-electrode line being scanned is terminated, a current flows from the capacitor $C_{SP}$ to the display cells via the field effect transistor $S_{SCH}$ of the upper scan circuit $D_U$+$S_{SCH}$, upper transistors of the switching output circuit SIC, and Y-electrode lines.

Figure 4:
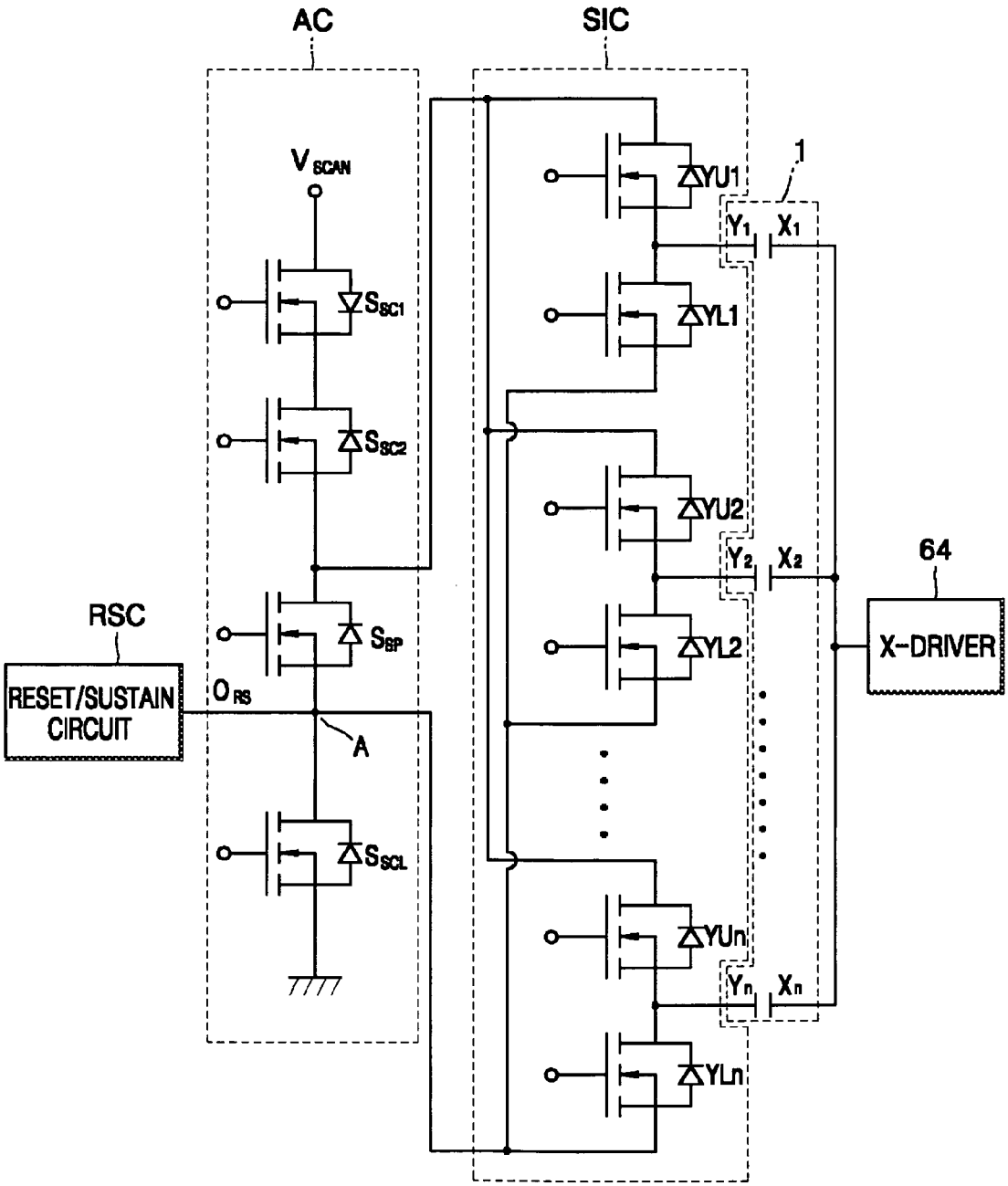
FIG. 4 (PRIOR ART)
FIG. 4 is a diagram of a Y-driver of a typical driving apparatus using an address-display separation driving scheme.

As described above, since a voltage of the capacitor $C_{SP}$ of the scan driving circuit AC is maintained constant, even when the number of high power transistors is decreased, that is, the high power transistors $S_{SC1}$, $S_{SC2}$, and $S_{SP}$ of the conventional Y-driver shown in FIG. 4 are removed, driving is stable, and a power consumption is not increased.

During the mixed period A4MS4 including the address period and the mixed display-sustain period, the display-sustain operation is performed during each even-numbered unit time. During the mixed display-sustain period and the compensation display-sustain period AS4, the field effect transistor as the lower scan circuit $S_{SCL}$, the field effect transistor $S_{SCH}$ of the upper scan circuit $D_U$+$S_{SCH}$, and the field effect transistor as the second switching circuit $S_{SSL}$ are turned off. In contrast, the first and second transistors $S_{SSU1}$ and $S_{SSU2}$ of the first switching circuit $S_{SSU1}+S_{SSU2}$ are turned on. Accordingly, the display-sustain driving signal $O_{RS}$ of the reset/sustain circuit RSC is applied to the upper common power line of the upper transistors YU1 through YUn of the switching output circuit SIC via the first switching circuit $S_{SSU1}+S_{SSU2}$.

In the meantime, the lower transistors YL1 through YLn are turned off, and selected upper transistors of the switching output circuit SIC are turned on. For example, during the second unit time of the mixed period A4MS4, upper transistors corresponding to the first Y-electrode group are turned on. As a result, the display-sustain driving signal $O_{RS}$ is applied to the first Y-electrode group, and thus an alternating current voltage is applied to XY-electrode line pairs corresponding to the first Y-electrode group. Although the display-sustain driving signal $O_{RS}$ is applied to the X-electrode lines $X_1$ through $X_n$, since the display-sustain driving signal $O_{RS}$ is applied to only the first Y-electrode group among all of the Y-electrode groups, the alternating current voltage is applied to only the XY-electrode line pairs corresponding to the first Y-electrode group. As a result, display-sustain discharge occurs only in selected display cells of the XY-electrode line pairs corresponding to the first Y-electrode group.

FIG. 6 is a diagram of the reset/sustain circuit included in the Y-driver shown in FIG. 5. Third through sixth transistors ST3 through ST6 and a ninth transistor ST9 generate a driving signal $O_{RS}$ to be applied to Y-electrode lines during the reset period R4 of FIG. 7. An energy regeneration capacitor $C_{SY}$, first through fifth transistors ST1 through ST5, and a tuning coil $L_Y$ generate a driving signal $O_{RS}$ to be applied to Y-electrode lines during the mixed display-sustain period, the common display-sustain period, and the compensation display-sustain period. An eighth transistor ST8 floats an output driving signal $O_{RS}$ during the address period. An operation of the reset/sustain circuit RSC of FIG. 6 will be described with reference to FIGS. 6, 7, 8A and 8B.

During the reset period R4, while a voltage applied to the X-electrode lines $X_1$ through $X_n$ continuously increases from the ground voltage $V_G$ to a second voltage $V_S$ equal to the display-sustain voltage $V_S$, only the fourth, fifth, and eighth transistors ST4, ST5, and ST8 are turned on. As a result, the ground voltage $V_G$ is applied to the Y-electrode lines $Y_1$ through $Y_n$.

Next, only the third, sixth, and eighth transistors ST3, ST6, and ST8 are turned on, and a third voltage $V_{SET}$ is applied to a drain of the sixth transistor ST6. Since a control voltage continuously increasing is applied to a gate of the sixth transistor ST6, a channel resistance value of the sixth transistor ST6 continuously decreases. In addition, since the second voltage $V_S$ has been applied to the third transistor ST3, due to the effect of a capacitor connected between the source of the third transistor ST3 and the drain of the sixth transistor ST6, a voltage continuously increasing from the second voltage $V_S$ to a maximum voltage $V_{SET}+V_S$ is applied to the drain of the sixth transistor ST6. As a result, the voltage continuously increasing from the second voltage $V_S$ to the maximum voltage $V_{SET}+V_S$ is applied to the Y-electrode lines $Y_1$ through $Y_n$. Meanwhile, the ground voltage $V_G$ is applied to the X-electrode lines $X_1$ through $X_n$, and the address electrode lines $A_{R1}$ through $A_{Bm}$. As a result, a weak discharge occurs between the Y-electrode lines $Y_1$ through $Y_n$ and the X-electrode lines $X_1$ through $X_n$, and a weaker discharge occurs between the Y-electrode lines $Y_1$ through $Y_n$ and the address electrode lines $A_{R1}$ through $A_{Bm}$. The reason that the discharge occurring between the Y-electrode lines $Y_1$ through $Y_n$ and the address electrode lines $A_{R1}$ through $A_{Bm}$ is weaker than the discharge occurring between the Y-electrode lines $Y_1$ through $Y_n$ and the X-electrode lines $X_1$ through $X_n$, is because negative wall charges have been formed around the X-electrode lines $X_1$ through $X_n$. Accordingly, a large amount of negative wall charges are formed around the Y-electrode lines $Y_1$ through $Y_n$, positive wall charges are formed around the X-electrode lines $X_1$ through $X_n$, and a small amount of positive wall charges are formed around the address electrode lines $A_{R1}$ through $A_{Bm}$ (see FIG. 8A).

Next, only the third, fifth, and eighth transistors ST3, ST5, and ST8 are turned on, and the second voltage $V_S$ is applied to the Y-electrode lines $Y_1$ through $Y_n$.

Next, only the fifth, seventh, eighth, and ninth transistors ST5, ST7, ST8, and ST9 are turned on, and the continuously increasing control voltage is applied to the gates of the respective seventh and ninth transistors ST7 and ST9. As a result, a channel resistance value of the seventh transistor ST7 continuously decreases. Accordingly, the voltage applied to the Y-electrode lines $Y_1$ through $Y_n$ continuously decreases from the second voltage $V_S$ to the ground voltage $V_G$. In this situation, the fifth, seventh, and eighth transistors ST5, ST7, and ST8 are turned off, and the voltage applied to the Y-electrode lines $Y_1$ through $Y_n$ continuously decreases from the ground voltage $V_G$ to a negative voltage $V_{SC}$ equal to a scan voltage. Here, the second voltage $V_S$ is applied to the Y-electrode lines $Y_1$ through $Y_n$, and the ground voltage $V_G$ is applied to the address electrode lines $A_{R1}$ through $A_{Bm}$. Accordingly, due to a weak discharge between the X-electrode lines $X_1$ through $X_n$ and the Y-electrode lines $Y_1$ through $Y_n$ some of the negative wall charges around the Y-electrode lines $Y_1$ through $Y_n$ move to the X-electrode lines $X_1$ through $X_n$ (see FIG. 8B). The ground voltage $V_G$ is applied to the address electrode lines $A_{R1}$ through $A_{Bm}$, and thus the amount of positive wall charges around the address electrode lines $A_{R1}$ through $A_{Bm}$ increases a little (see FIG. 8B).

During the address period performed during each odd-numbered unit time in the mixed period A4MS4, all of the transistors of the reset/sustain circuit RSC are turned off, and an output of the reset/sustain circuit RSC is floated.

During the mixed display-sustain period performed during each even-numbered unit time in the mixed period A4MS4, during the common display-sustain period CS4, and during the compensation display-sustain period AS4, while a voltage of the pulses applied to all or selected Y-electrode lines drops from the second voltage $V_S$ as a display-sustain voltage to the ground voltage $V_G$, only the second, fifth, and eighth transistors ST2, ST5, and ST8 are turned on. Accordingly, charges unnecessarily remaining in display cells (i.e., electric capacitors) are collected in the energy regeneration capacitor $C_{SY}$. The collected charges are reused to be applied to all or selected Y-electrode lines while a voltage increases from the ground voltage $V_G$ to the second voltage $V_S$.

More specifically, during the mixed display-sustain period performed during each even-numbered unit time in the mixed period A4MS4, during the common display-sustain period CS4, and during the compensation display-sustain period AS4, while a voltage of the pulses applied to all or selected Y-electrode lines increases from the ground voltage $V_G$ to the second voltage $V_S$, only the first, fifth, and eighth transistors ST1, ST5, and ST8 are turned on. As a result, charges collected in the energy regeneration capacitor $C_{SY}$ are applied to all of the Y-electrode lines $Y_1$ through $Y_n$ or the selected Y-electrode lines. Next, only the third, fifth, and eighth transistors ST3, ST5, and ST8 are turned on, and thus the second voltage $V_S$ as a display-sustain voltage is applied to all of the Y-electrode lines $Y_1$ through $Y_n$ or the selected Y-electrode lines. Next, while the voltage drops from the second voltage $V_S$ to the ground voltage $V_G$, only the second, fifth, and eighth transistors ST2, ST5, and ST8 are turned on. As a result, charges unnecessarily remaining in display cells (i.e., electric capacitors) are collected in the energy regeneration capacitor $C_{SY}$. Finally, only the fourth, fifth, and eighth transistors ST4, ST5, and ST8 are turned on, and the ground voltage $V_G$ is applied to all of the Y-electrode lines $Y_1$ through $Y_n$ or the selected Y-electrode lines.

As described above, in an apparatus for driving a plasma display panel according to the present invention, the Y-driver connects or disconnects the upper and lower common power lines of the switching output circuit SIC to or from the output terminal of the reset/sustain circuit RSC using the first switching circuit $S_{SSU1}+S_{SSU2}$ and the second switching circuit $S_{SSL}$. Accordingly, driving signals of the reset/sustain circuit RSC can be controlled to be applied to all of the Y-electrode lines $Y_1$ through $Y_n$ via the upper and lower common power lines of the switching output circuit SIC and the internal diodes of all transistors YU1 through YLn of the switching output circuit SIC.

For example, when the second switching circuit $S_{SSL}$ is disconnected, positive pulses of the reset/sustain circuit RSC are applied to the upper common power line of the upper transistors YU1 through YUn, and the upper transistors YU1 through YUn are selectively turned on, a display-sustain signal can be selectively applied to each XY-electrode line pair group including at least one XY-electrode line pair. As a result, in each subfield, addressing and display-sustain discharge are alternately performed, and a display-sustain signal can be applied only to XY-electrode line pair groups on which addressing has been completed. Accordingly, a standby duration of an XY-electrode line pair group between a time the XY-electrode line pair group is completely addressed and a time when other XY-electrode line pair groups are completely discharged is decreased so that accuracy of display-sustain discharge is increased.

Although a few embodiments of the present invention have been shown and described, it will be appreciated by those skilled in the art that changes may be made in these elements without departing from the principles and spirit of the invention, the scope of which is defined in the appended claims and their equivalents.

What is claimed is:

1. A scan electrode driver for a plasma display panel, comprising:

a switching output circuit having a pair of an upper transistor and a lower transistor, and a common output line coupled to the pair of the upper transistor and the lower transistor, wherein the common output lines is coupled to a scan electrode line;

a reset/sustain circuit that outputs a driving signal during a reset period and a display-sustain period; and a scan driving circuit including an upper scan circuit and a lower scan circuit, wherein the scan driving circuit further comprises a first switching circuit and a second switching circuit.

2. The scan electrode driver of claim 1, wherein the upper scan circuit is connected to an upper common power line of the upper transistor and the lower scan circuit is connected to a lower common power line of the lower transistor.

3. The scan electrode driver of claim 2, where in the upper scan circuit applies a scan bias voltage to the scan electrode lines that is not to be scanned during an address period, and wherein the lower scan circuit applies a scan voltage to the scan electrode lines that is to be scanned during the address period.

4. The scan electrode driver of claim 1, wherein the first switching circuit switches between the upper common power line and the reset/sustain circuit; and wherein the second switching circuit switches between the lower common power line and the reset/sustain circuit.

5. The scan electrode driver of claim 1, wherein the upper transistor and the lower transistor of the switching output circuit are field effect transistors, each of which includes an internal diode.

6. The scan electrode driver of claim 5, wherein an anode of the internal diode is coupled to a source of the field effect transistor and a cathode of the internal diode is coupled to a drain of the field effect transistor, and wherein a source of the upper transistor and a drain of the lower transistor are coupled to the scan electrode line.

7. The scan electrode driver of claim 1, wherein the first switching circuit comprises a first transistor and a second transistor that are coupled between the upper common power line of the upper transistor and an output terminal of the reset/sustain circuit.

8. The scan electrode driver of claim 7, wherein the first transistor and the second transistor are field effect transistors, each of which includes an internal diode.

9. The scan electrode driver of claim 7, wherein an anode of the internal diode is coupled to a source of the field effect transistor and a cathode of the internal diode is coupled to a drain of the field effect transistor, and wherein a source of the upper transistor and a drain of the lower transistor are coupled to the scan electrode line.

10. The scan electrode driver of drain 1, wherein the second switching circuit comprises a transistor coupled between the lower common power line of the lower transistor and an output terminal of the reset/sustain circuit.

11. The scan electrode driver of claim 10, wherein the transistor is a field effect transistor that includes an internal diode.

12. The scan electrode driver of claim 11, wherein an anode of the internal diode is coupled to a source of the field effect transistor and a cathode of the internal diode is coupled to a drain of the field effect transistor, and wherein the source of the field effect transistor is coupled to the lower common power line of the lower transistor and the drain of the field effect transistor is coupled to the output terminal of the reset/sustain circuit.

13. The scan electrode driver of claim 1, further comprising a capacitor coupled between the upper scan circuit and the lower scan circuit.

* * * * *